US005280216A

United States Patent [19]

Mourier

[11] Patent Number: 5,280,216

[45] Date of Patent: Jan. 18, 1994

[54] MODE CONVERTER AND POWER SPLITTER FOR MICROWAVE TUBES

[75] Inventor: Georges Mourier, Mareil sur Mauldre, France

[73] Assignee: Thomson Tubes Electroniques, Boulogne Billancourt, France

[21] Appl. No.: 819,963

[22] Filed: Jan. 13, 1992

[30] Foreign Application Priority Data

Feb. 12, 1991 [FR] France ..... 91 01585

[51] Int. Cl.[5] ..... H01J 23/40; H01P 1/16

[52] U.S. Cl. ..... 315/5; 333/21 R; 333/113; 333/137

[58] Field of Search ..... 315/4, 5, 5.29, 5.31, 315/5.15; 333/21 R, 137, 125, 113, 117

[56] References Cited

U.S. PATENT DOCUMENTS

| | | | |
|---|---|---|---|
| 4,306,174 | 12/1981 | Mourier | 315/4 |
| 4,549,111 | 10/1985 | Mourier | 315/4 |
| 4,563,615 | 1/1986 | Mourier | 315/39.3 |
| 4,567,401 | 1/1986 | Barnett et al. | 333/230 X |
| 4,567,402 | 1/1986 | Mourier | 315/39.3 |
| 4,571,524 | 2/1986 | Mourier | 315/4 |
| 4,585,965 | 4/1986 | Mourier | 315/39.3 |
| 4,604,551 | 8/1986 | Moeller | 315/5 X |
| 4,628,287 | 12/1986 | Zinger et al. | 333/21 R X |
| 4,636,689 | 1/1987 | Mourier | 315/4 |
| 4,661,744 | 4/1987 | Mourier | 315/4 |
| 4,897,609 | 1/1990 | Mallavarpu | 330/43 |
| 4,933,594 | 6/1990 | Faillon et al. | 313/153 |
| 5,030,929 | 7/1991 | Moeller | 315/4 X |
| 5,043,629 | 8/1991 | Doane | 315/5 |
| 5,059,928 | 10/1991 | Mourier et al. | 333/21 R |

FOREIGN PATENT DOCUMENTS

| | | |
|---|---|---|
| 0372975 | 6/1990 | European Pat. Off. . |
| 2543368 | 9/1984 | France . |
| 2613534 | 10/1988 | France . |
| WO8403178 | 8/1984 | PCT Int'l Appl. . |

*Primary Examiner*—Benny T. Lee

*Attorney, Agent, or Firm*—Oblon, Spivak, McClelland, Maier & Neustadt

[57] ABSTRACT

The invention is a mode converter and power splitter device for electron tubes, particularly gyrotrons and tubes of similar categories. These tubes have an output cavity 2, which is a circular form about a centerline, and a hollow electron beam 1 which propagates along the same centerline. The device complying with the invention is a structure which comprises secondary wave guides 6, symmetrical in azimuth around the same centerline as the outlet cavity, each guide 6 containing coupling apertures 7 on its outer wall (that furthest from the centerline), these apertures 7 being arranged to excite a given mode in the guide. One important embodiment of the invention is that the electron tube operates in a $TE_{m,n}$ mode with a high azimuth index m and the number of secondary guides 1=m. Another important embodiment of the invention is that secondary guides 6 are trapezoidal in section. Another important embodiment of the invention is that secondary guides 6 are excited in the fundamental mode. Another embodiment of the invention is that the secondary guides can include individual microwave windows 58 outside the electron tube. The invention may find application for plasma heating for thermonuclear fusion and particle accelerators.

5 Claims, 6 Drawing Sheets

MODE CONVERTER AND POWER SPLITTER FOR MICROWAVE TUBES

BACKGROUND OF THE INVENTION

This invention is a mode converter that can be incorporated into a gyrotron-type microwave tube. Its structure splits the microwave power emitted by the tube into several parts and the structure is, therefore, particularly suitable for applications where the power must be split before use.

Two typical examples of applications are particle accelerators and thermonuclear fusion. In both cases, very high-power (for example, from on the order of one to several megawatts) microwave energy sources are used but the power is spread over a wide area by a feeder/splitter known as a "grill". This spreads the power over several transmission lines via successive branches.

This invention will be particularly advantageous in the frequency range on the order from one to many tens of GHz. The higher frequencies, with wavelengths of the order of a millimeter or even less, are required to heat thermonuclear plasma by electron cyclotron resonance. At these frequencies, the resistive losses on the walls of waveguides and resonant cavities, and the problems involved in transmitting microwave energy through microwave windows, are determining factors in choosing appropriate technology to be used.

However, lower frequencies (on the order of one to a few tens of GHz) are required to heat the plasma by ion resonance or lower hybrid resonance. The maximum power obtained from klystrons at these frequencies does not exceed roughly 1 MW (megawatt) at the lower end of the range and can drop to 100 kW at frequencies above a few GHz. Consequently, large numbers of klystrons would be required to obtain several MW and this would be extremely expensive. Consequently, the possibility of using gyrotrons as microwave generators is being considered since the maximum power obtainable from a gyrotron at high frequency is typically higher than that obtained from prior art klystrons by a factor of 10 to 100.

However, gyrotrons were not originally designed to operate at these low frequencies (on the order of one to a few tens of GHz). The technical problems involved in designing such a low-frequency gyrotron differ considerably from those encountered in gyrotrons operating at frequencies over a range from tens to hundreds of GHz.

In particular, the electron collector is difficult to produce and is bulky due to the high power to be dissipated. For example, a 3 MW gyrotron with an efficiency of 50% will need to dissipate 3 MW on the collector walls. This requires a large cooling capacity, generally provided by fast-flowing water, requiring large volumes to be pumped at high pressures. This implies bulky, cumbersome piping systems.

The microwave power is extracted in the same area (close to the collector) via a microwave window which is hermatically sealed but transparent to electromagnetic radiation at the operating frequencies. At these high powers, the window must also be cooled.

In the prior art, the gyrotron power is split, several times, downstream of the window and distributed through an appropriate number of waveguides arranged in a tree-structure starting from the window (see FIG. 6).

Consequently, a gyrotron complying with the prior art and generating, for example, several MW's at a few GHz, requires a cumbersome cooling water pipework system and a large number of waveguides to transmit the microwave power, all in the same area, i.e. close to the gyrotron electron collector. The arrangement of the outlet guide(s) and the collector is always a considerable problem in high-power gyrotrons.

In a similar way, the microwave window presents problems which increase as the power increases, due to the heating of the window caused by dielectric losses in the window material and the mechanical stresses caused by thermal expansion of the window. These effects can destroy the window, making the gyrotron unusable.

DESCRIPTION OF THE PRIOR ART

One solution known to the prior art, through a U.S. application Ser. No. 07/692,448 filed Apr. 25, 1991 (now abandoned), in the applicant's name, is to couple several waveguides to the outside of the sidewalls of a waveguide connected to the gyrotron cavity. In this construction, the secondary waveguides are adjacent to the outside of the main waveguide walls and are coupled to it by coupling apertures. The dimensions and spacing of the holes, the dimensions of the guides and the coupling area are designed to convert from the source mode (typically, a gyrotron has a high-order mode) to the required mode, generally a much lower order (or even the fundamental) to facilitate the propagation and final use of the energy. One advantage of this construction is that the power from the source is distributed over several secondary waveguides which can have individual microwave windows. The power passing through each window is then reduced by a factor equal to the number of windows. The secondary guides can then be coupled to another guide capable of propagating the microwave energy, in the desired mode, to the microwave load (for example, a particle accelerator).

A study of the interactions between the electromagnetic field and the electron beam in an electron tube output cavity (the only cavity in a gyrotron or the last cavity in a gyroklystron or any other device with several cavities) shows it is advantageous to use a hollow electron beam (1) whose diameter is slightly less than the cavity diameter (FIG. 1), combined with a high electrical field in the area of the beam, close to the cavity wall (2). This optimizes the efficiency with which the beam and the field interact while avoiding excessively high electromagnetic energy in the cavity.

Consequently, one aim is to excite the microwave generator oscillation in modes such that the energy stored in the fields is located close to the wall. Industry generally refers to these modes as the "Whispering Gallery Modes".

FIG. 2 illustrates an example of a $TE_{9,1}$ mode, in which the energy is concentrated close to the wall, and shows the instantaneous electric field. The mode illustrated is effectively used in power gyrotrons. It shows that the electric fields are weak, or even zero, in the center of the cavity and inside cylinder (4) shown by the dotted line on FIG. 2. It should, therefore, be possible to place a single central guide coaxially in this space without excessively interferring with the surrounding electromagnetic fields.

This arrangement is described in C. MOELLER's U.S. Pat. No. 4 523 127 and allows the microwave energy from the tube (a cyclotron resonance maser) to be coupled to a single outlet guide via a large number of small dielectric windows in the coaxial guide wall. This solution was designed, and is efficient, for tubes operating at frequencies up to over a range from tens or hundreds of GHz but is not optimum in all cases, particularly in the case covered by this invention.

This is due to the fact that, at frequencies below roughly a few tens of GHz, the electromagnetic fields are weaker and are virtually homogeneous over a larger area; consequently, the losses due to high-frequency electric currents induced in the walls are lower. It then becomes possible and preferable to place a set of several guides in the center of the outlet cavity as shown in an example of an embodiment of this invention on FIG. 4.

SUMMARY OF THE INVENTION

This invention offers several advantages compared to the prior art as described in U.S. Pat. No. 4,523,127. The prior art requires a large number of small dielectric windows cooled by a liquid or gas flowing inside channels produced in the coaxial guide wall. The system would, doubtless, be relatively difficult to produce.

The number, arrangement and dimensions of the coupling apertures (closed by dielectric windows) are designed to avoid mode conversion and the microwave power in the outlet guide is virtually equal to that in the source less any losses (electric currents in the metal walls, dielectric losses), which must be dissipated by the cooling circuit.

With this invention, with the example of an embodiment shown on FIG. 4, the high-frequency losses are lower for the reasons explained above (and FIG. 4 clearly shows that the secondary guides 6 are in a weak field area). This facilitates construction of the device of the present invention.

There are no windows on the secondary guide 6 coupling apertures and, therefore, no cooling inside the electron tube. The number, arrangement and dimensions of coupling apertures 7 can be selected to excite the fundamental mode in secondary guides 6, offering many advantages. The secondary guides, excited in the fundamental mode, can have a variable section and/or be curved without generating unwanted modes. They can also be fitted with microwave windows using conventional matching techniques and the fact that they are more easily accessible from outside the electron tube will make them easier to cool, if necessary.

The fact that the microwave power P generated by the tube is carried by secondary guides (for example, 1 guides) via 1 windows means that the means power through each window is P/1.

Consequently, the heating of each window due to dielectric losses in transmitting the microwave energy can be less than with a single window and these windows will be easier to cool because they are smaller and more easily accessible, being around the periphery at a certain distance from the tube.

Moreover, for use in plasma heating systems for thermonuclear reactors such as a Tokomak, the microwave energy must be transmitted to the plasma in the fundamental mode. This invention allows the mode to be converted at source and thus avoids the requirement for a mode converter in the guide as required by the prior art.

Again, for the same plasma heating applications, the power must be distributed, before application to the plasma, by a "grill" of varying degrees of complexity (see FIG. 6), downstream of a series of branches. With this invention, the structure ensures that the source microwave power is already distributed into several secondary guides. In fact, each secondary guide will again have to be split to excite the Tokomak circuit but this invention will require less splitters than the prior art.

Moreover, with a device complying with this invention, the conditions under which the power is split are particularly favorable since the secondary guides can easily be excited coherently provided the geometry used is perfectly symmetrical (see FIG. 4). There is no problem in matching the source and secondary guides for this first distribution whereas, in the prior art, the matching and coherent excitation of secondary guides posed significant technological problems.

This invention is, therefore, a mode converter and power splitter device for microwave tubes, the microwave tube possessing at least one cavity, known as the output cavity, to allow extraction of the microwave energy generated by an electron beam, this cavity being a form of revolution around a longitudinal centerline z and the electron beam propagating at least approximately parallel to this centerline z, in which:

the device is a structure comprising several secondary waveguides, these waveguides being arranged symmetrically around a centerline z', the structure being placed in the said outlet cavity so that the centerline z' coincides with the centerline z;

the secondary guides have coupling apertures over part of their length parallel to centerline z', this length and the number, spacing and dimensions of the apertures being selected to excite the required propagation mode in the secondary guide.

The dimensions and arrangement of the secondary guides are designed to match the dimensions and arrangement of the electron beam so that they present no obstacle to the propagation of this beam.

This invention is also an electron tube including a mode converter and power splitter device as described above.

In a preferred embodiment of the invention, the electron tube is of the gyrotron type. In other important embodiments, the tube is a variant of the gyrotron type (gyroklystron, gyro-TWT, cyclotron-resonant maser, gyro-BWO, etc.).

Another important embodiment of the invention is that the electron beam is hollow with a form or revolution around the centerline z. Another embodiment is that the structure comprises several secondary waveguides placed inside the hollow beam and coaxial with it.

Another important embodiment of the invention is that the electron tube operates in a $TE_{mn}$ mode with an azimuth index m considerably greater than unity and that there are m secondary waveguides; another embodiment is that there are 2 m secondary waveguides. A general embodiment is that the number 1 of secondary waveguides is $1=2\ m/i$ where i is a non-zero whole number.

Another important embodiment of the invention is that the coupling apertures are designed to produce only the fundamental mode excitation in the secondary guides.

BRIEF DESCRIPTION OF DRAWINGS

The invention will be better understood and other advantages will become clear upon reading the following description of a few non-exhaustive examples of embodiments, illustrated by the appended drawings of which.

These figures are non-exhaustive examples of embodiments of the invention, in which the same numbers designate the same components on all figures. Industry will easily be able to find other embodiments of the invention or its main characteristics based on these examples.

DESCRIPTION OF THE PREFERRED EMBODIMENTS

Figure 1:
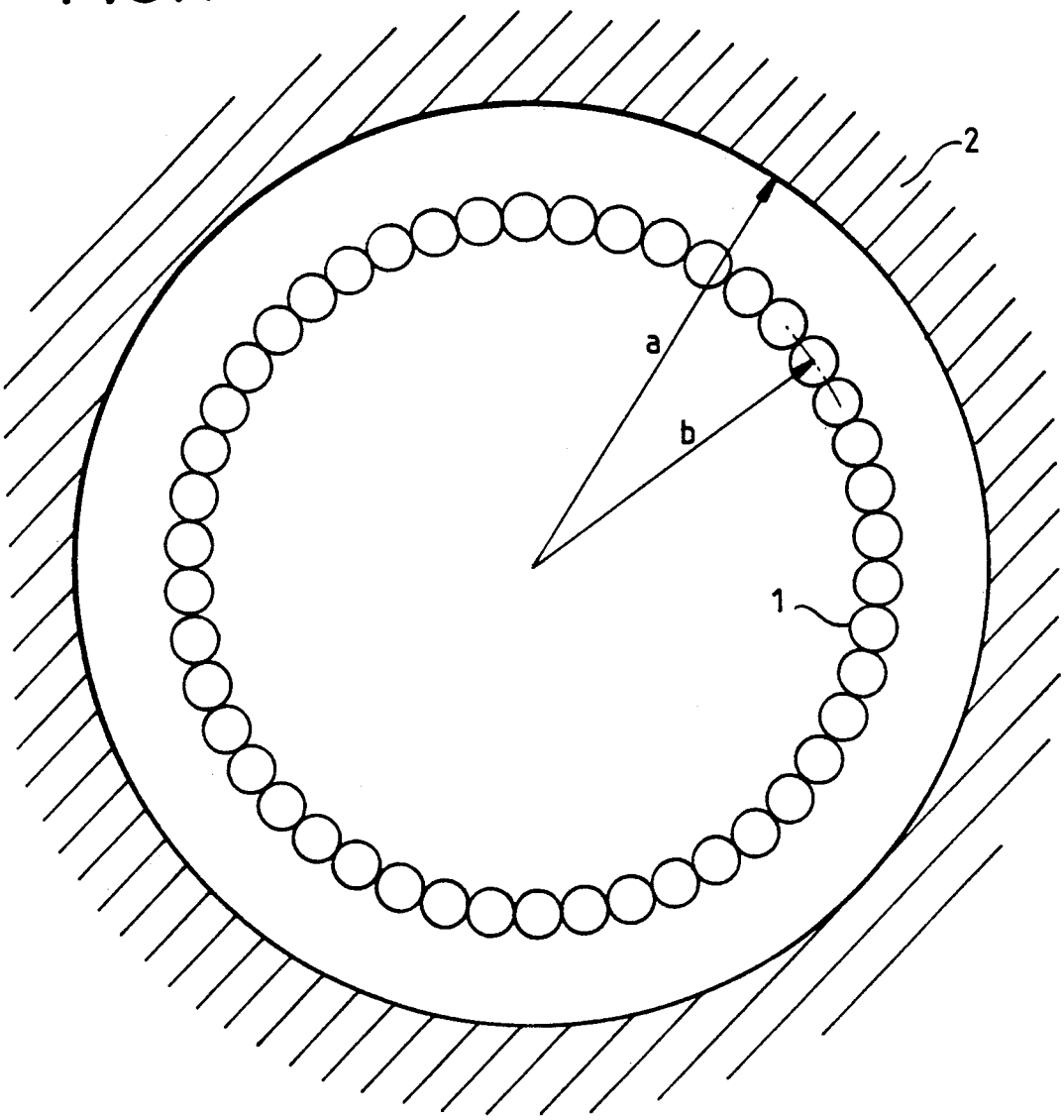
FIG. 1 is a cross-section, perpendicular to the longitudinal centerline, of the hollow electron beam inside a gyrotron cavity.

FIG. 1 is a cross-section, perpendicular to the centerline of an electron tube, showing the outlet cavity wall 2 within which the electron beam 1 propagates. The cavity is circular in section with radius a; The beam is circular in section with radius b, smaller than a. The tube may, for example, be a gyrotron in which case there is only one cavity. However this cavity could also be the last cavity in a multi-cavity tube such as, for example, a gyroklystron. In the case of a gyrotron, electron beam 1 is hollow and propagates parallel to the longitudinal centerline of the tube close to wall 2. A cross-section on the beam would reveal innumerable small circles representing the cyclotronic orbits of each electron around the confining magnetic lines of force; these lines of force are also parallel to the tube longitudinal centerline.

Figure 2:
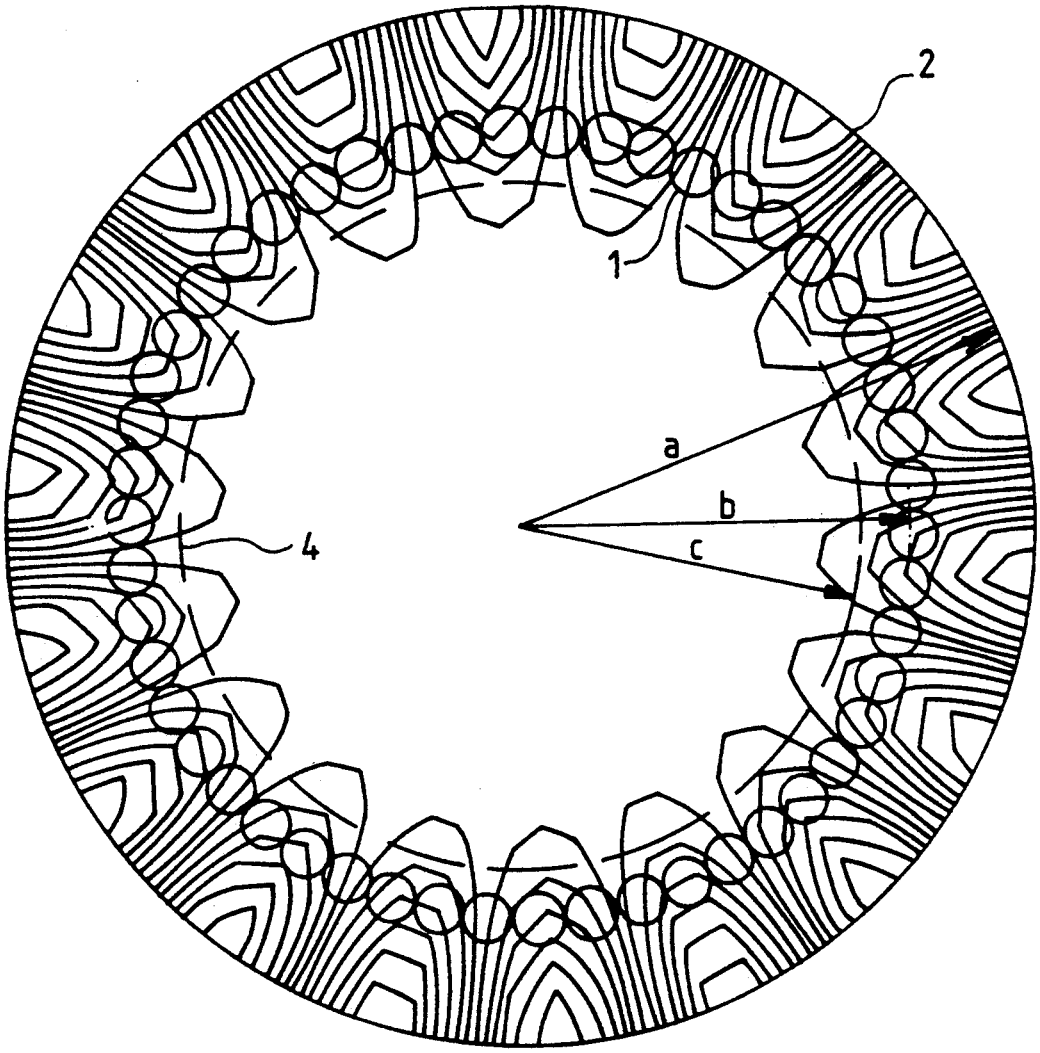
FIG. 2 (PRIOR ART)
FIG. 2 shows the electric field lines for the $TE_{9,1}$ propagation mode.

FIG. 2 shows the electric lines of force in the $TE_{9,1}$ mode that exist inside the cavity shown on FIG. 1. A gyrotron typically generates microwave electromagnetic energy in a high-order oscillation mode. Computer calculations, confirmed by experiments, show that the interaction between the electron beam 1 and the electromagnetic fields is optimized when the field strength and beam density are concentrated in the same area close to the cavity wall. For this reason, the objective is to excite a mode with unit radial mode number, as shown on FIG. 2.

FIG. 2 shows that the $TE_{9,1}$ mode lines of force do not penetrate far into the cavity. Consequently, with this configuration of fields and beam, it is possible to add a metal part inside the tube, in the area indicated by circle 4 with radius c, without excessively interfering with the fields. This remark is fundamental to this invention. The azimuth symmetry of the part must be compatible with that of the fields (that is identical to or a multiple of the field azimuth index) and it must be carefully positioned on the same longitudinal centerline as the tube and be coaxial with it.

Figure 3A:
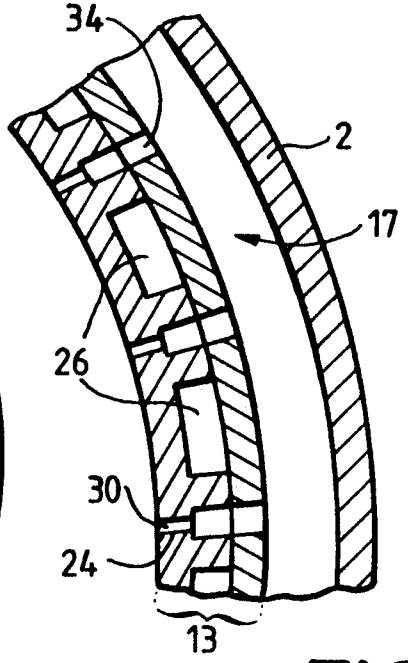
FIG. 3a (PRIOR ART)
FIG. 3*a* shows a detail of a portion of FIG. 3.
Figure 3:
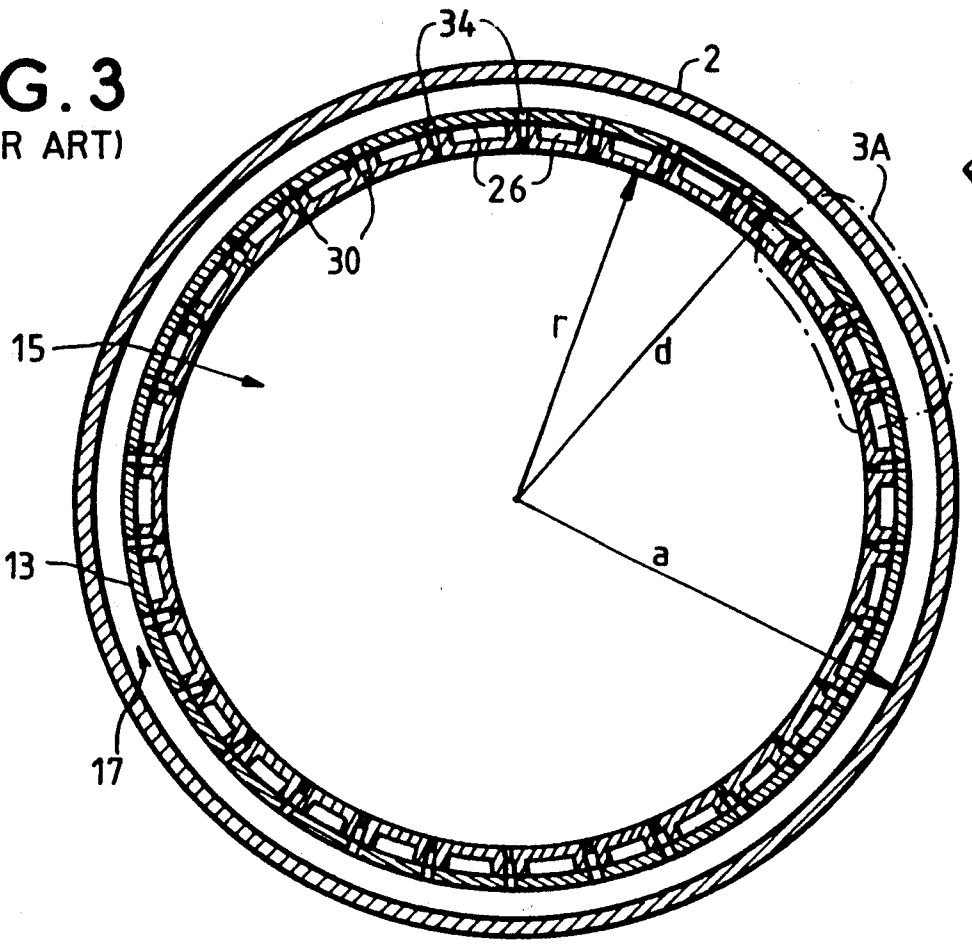
FIG. 3 (PRIOR ART)
FIG. 3 is a cross-section, perpendicular to the longitudinal centerline, of a microwave window complying with the prior art.

FIG. 3 and detail 3A show, in a configuration known to the prior art (in document U.S. Pat. No. 4,532,127), a coaxial microwave window geometry designed to extract microwave power from a gyrotron-type electron tube. Inside circular wall 2 of radius a, which could, for example, be a gyrotron cavity, there is a metal part 13, circular in section and with inside radius r and outside radius d; its thickness is, therefore, d−r. Part 13 is coaxial with wall 2. Part 13 contains a large number of slots 34 coupled by apertures 24, (see FIG. 3*a*) hermetically closed by dielectric windows 30. These windows 30 are cooled by channels 26 through which a cooling liquid or gas flows. According to the inventor, this structure allows the electromagnetic energy in annular space 17, between the inner face of wall 2 and the outer face of part 13, to be coupled to space 15, (see FIG. 3) inside part 13, without causing any mode conversion. This structure allows the energy generated by the gyrotron to be extracted via dielectric windows 30, which also form a seal between space 15 in the outlet guide and space 17 inside the tube. Space 17 can then be held at the high vacuum required to operate the tube while space 15 in the guide outlet can be filled with pressurized inert gas, air, etc.

Figure 4:
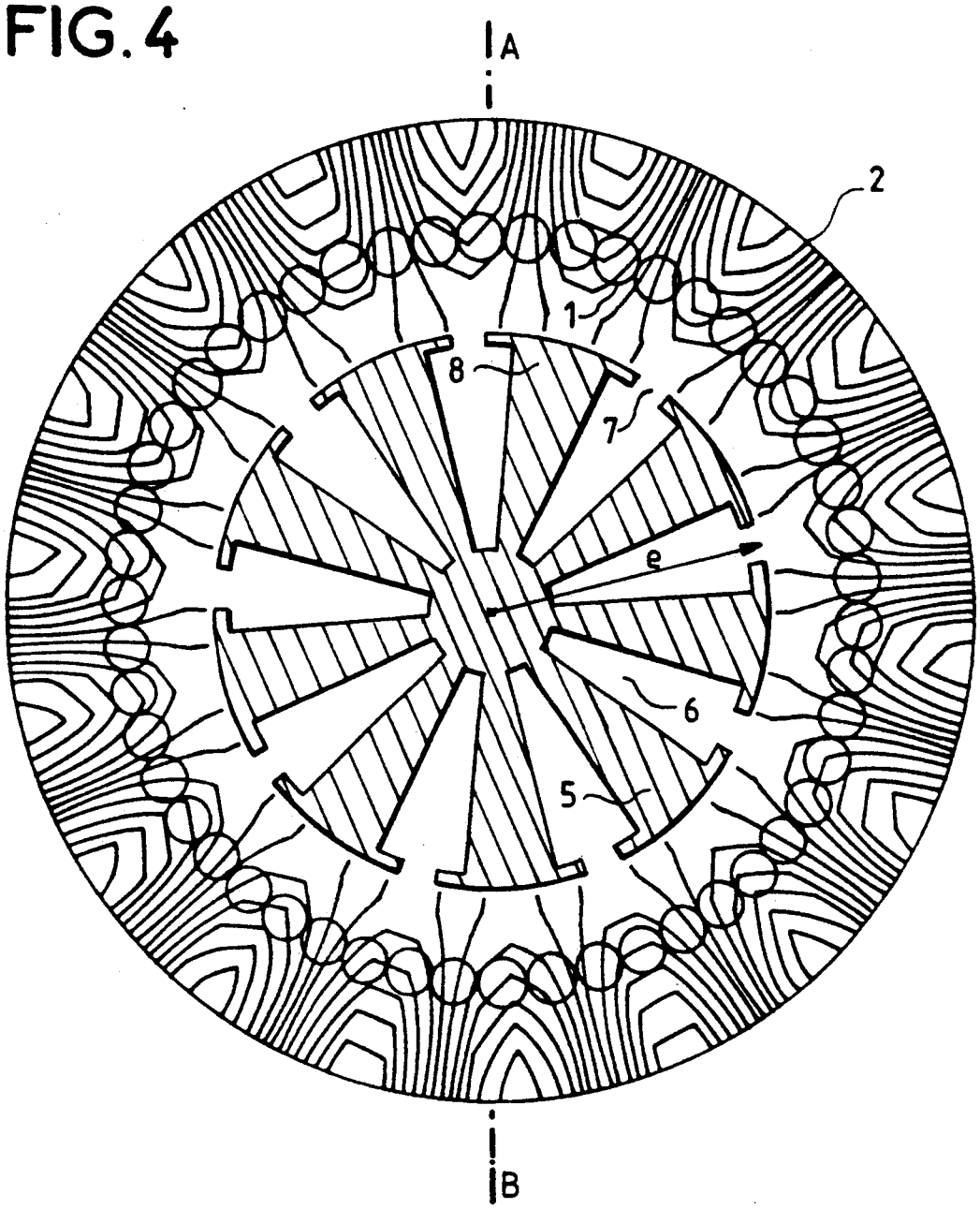
FIG. 4 is a cross-section, perpendicular to the longitudinal centerline, schematically representing an example of a mode converter and power splitter complying with the invention.

FIG. 4 shows a cross-section, perpendicular to the longitudinal centerline, of a device complying with this mode converter and power splitter invention. Structure 5 is circular in section, with radius e, and placed coaxially with the electron beam 1 and the cavity wall 2. Comparing the electric lines of force of FIG. 4 with the undisturbed lines on FIG. 2 shows that introducing structure 5 into the cavity leads to only minimum pertubations, which are vitually inexistant in the zone through which the electron beam passes.

Structure 5 comprises 1 secondary waveguides 6, trapezoidal in section. These secondary waveguides 6 are separated by metal walls 8 which are also trapezoidal in section and 1 in number. One can also easily imagine utilizing special shapes for the secondary waveguides, walls and structure from this representative example.

The 1 secondary guides 6 are coupled to the electromagnetic energy in the outlet cavity via coupling holes 7 produced in the outer wall of structure 5 and lying opposite the inner face 2 of the outlet cavity wall. Electromagnetic coupling through these apertures allows microwave power B to be transferred from the cavity to secondary waveguides 6, of which there are 1, each carrying, therefore, P/1. In the example on FIG. 4, the gyrotron oscillation mode is $TE_{9,1}$ and the number of secondary guides l=9. Consequently, the secondary guides are excited in phase, i.e. coherently. The shape, number and position of the coupling apertures will be selected to excite the fundamental mode $TE_{0,1}$ in the secondary waveguides 6; the methods conventionally used for aperture microwave couplers, well-known to industry, remain valid. Since the secondary guides are excited in the fundamental mode, their sections can easily be changed with no risk of conversion to unwanted modes and it is known how to match rectangular guides to these secondary guides using conventional methods.

In general terms, satisfactory results can be obtained in converting a mode $TE_{m,n}$ using 1 secondary guides provided that twice the azimuth index m is a multiple of the number of guides 1:2 m=il where i is a whole number other than zero. As an illustration, we chose the simplest case with m=1.

The azimuth symmetry, of order m=1, of the oscillation mode to be converted means the power will be identically shared between the 1 secondary guides. The microwave frequency P in the outlet cavity will be entirely restored by in the 1 secondary guides provided the following conditions are satisfied:

resistive or other losses are negligible, the phase velocity of the two modes propagated through the circular cavity and in the 1 secondary guides are equal allowing for its modification by the apertures, the length L (see FIG. 5) covered by the apertures is selected to match the coupling effect produced by the apertures and their number per unit length.

Several criteria are used to select the aperture dimensions and the coupling length L. In practice, special care will be taken with the electric field density in the holes, since this can lead to arcing and must be avoided by using a large number of small apertures spread over a long distance.

Figure 5:
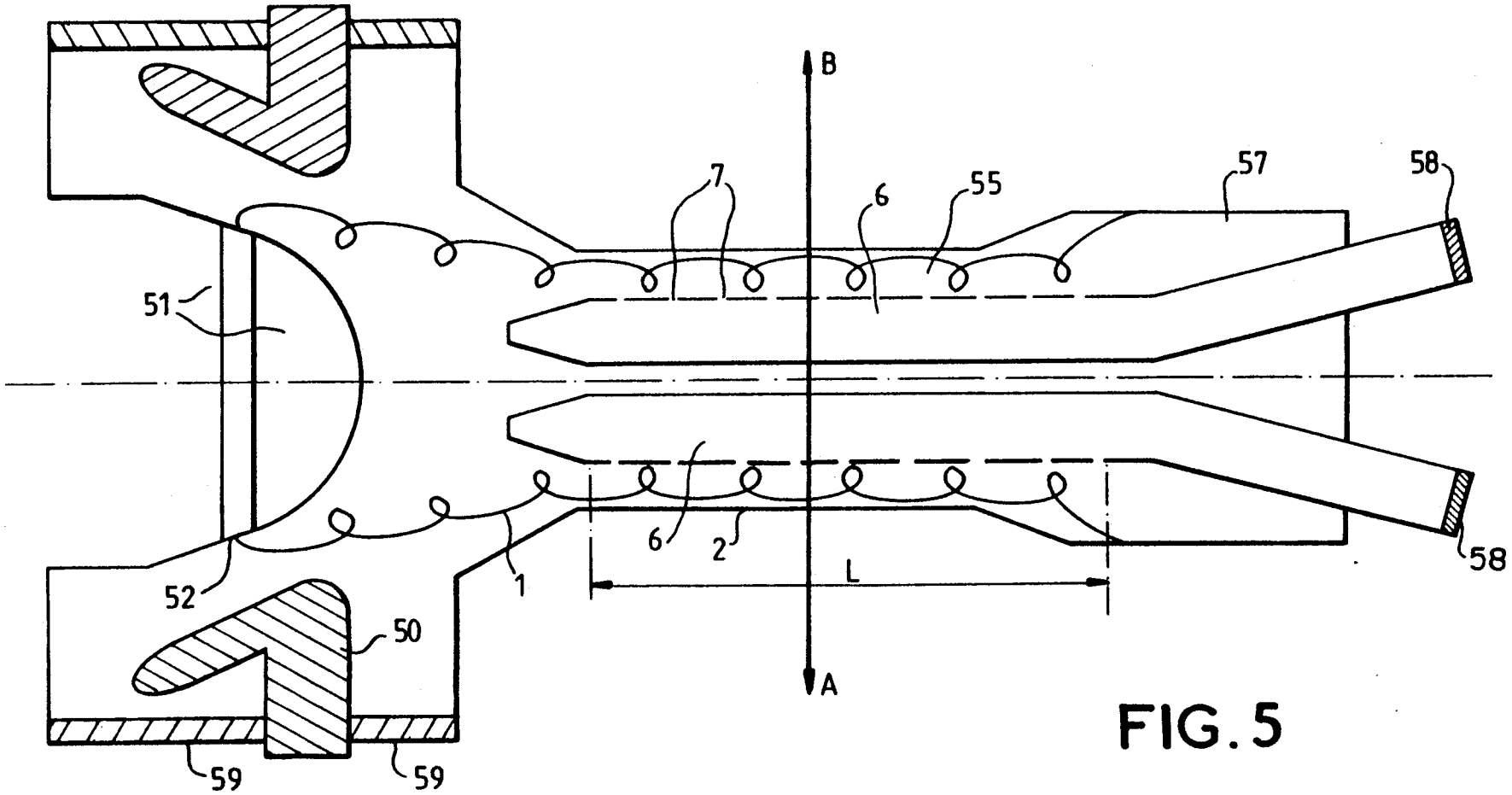
FIG. 5 is schematic longitudinal cross-section on a gyrotron including a mode converter and power splitter complying with the invention.

FIG. 5 is a longitudinal section of a gyrotron including a mode converter and power splitter complying with the invention. A cross-section perpendicular to the longitudinal section line, for example at plane A,B, would give, for example, FIG. 4. This gyrotron is symmetrical about an axis of revolution shown as a dotted line on the figure. A heavy electron current is generated at the emitting surface 52 of cathode 51 and is accelerated by electrostatic forces.

Any divergence due to the space charge, of the electron beam in the cavity is avoided by applying an axial magnetic field (not shown) generated by an electric current passed through coils (not shown), which may be superconductors. The high acceleration voltages are applied across the electron gun electrodes (cathode 51 and its support/anode 50), electrically insulated from each other by insulator 59. The electrons follow a relativistic cyclotron path around the magnetic lines of force generated by the electromagnets.

The azimuthal kinetic energy of the electrons and the microwave energy interact in cavity 55. Following this coupling, the electrons are attracted to the walls of collector 57, where impact with these walls convert their residual energy into heat which is evacuated by a cooling circuit (not shown). The microwave energy generated in cavity 55 is transmitted to secondary waveguide 6 via coupling holes 7 which extend over a length L determined from the criteria mentioned above.

In this example of an embodiment of the invention, each secondary guide includes a microwave window 58 outside the gyrotron vacuum chamber. This makes it easier to cool the windows than the conventional solution with a single microwave outlet window since the multiple windows are smaller and the lower power (P/1) transmitted by each and the fact that these windows are remote from the gyrotron itself and spread around a circumference, making it easier to install the cooling equipment.

Window 58 is generally in ceramic; it must be hermetically sealed to protect the vacuum in the tube but transparent to microwave energy. The microwave energy is then released to the microwave load (not shown) which could, for example, be a Tokomak.

As shown in FIG. 5, and as briefly explained above, the electrons from the gun propagate to the collector along the gyrotron and are virtually parallel to the longitudinal centerline in the area in which the beam reacts with the HF electromagnetic fields. However, the electron trajectories are generally divergent in collector 57 to distribute the heat dissipated (due to electrons with non-zero energy impacting on the collector walls) as evenly as possible. Another advantage of this configuration complying with the invention lies in the filter effect of the converter mode: in general, any waves reflected by the load can never reach the windows nor the gyrotron outlet cavity since only the fundamental mode $TE_{0,1}$ can be excited in the secondary guides.

In addition, the fundamental propagation mode is relatively insensitive to geometrical variations in the propagation path and this makes it easier to propagate the microwave energy without any risk of converting it to unwanted modes. This is particularly valuable in practical gyrotron installations where the gyrotron generally operates vertically but separated horizontally from the load a distance on the order of tens of meters. The waveguides which connect the gyrotron vertical outlet to the load, at some distance from the gyrotron, therefore normally contain an elbow. However, it is delicate to introduce elbows into conventional waveguides, which are generally oversized for the applications, since the guides can propagate microwave energy in many different more or less complex modes and the elbow can easily convert the modes propagated by the oversize guide into unwanted modes. To avoid this, in prior art products, very large curve radii were used for elbows, thus considerably increasing the bulk of the system. With the device described in this invention, the microwave power is in the fundamental mode as soon as it leaves the microwave source and, thus, all the above problems are eliminated.

Figure 6:
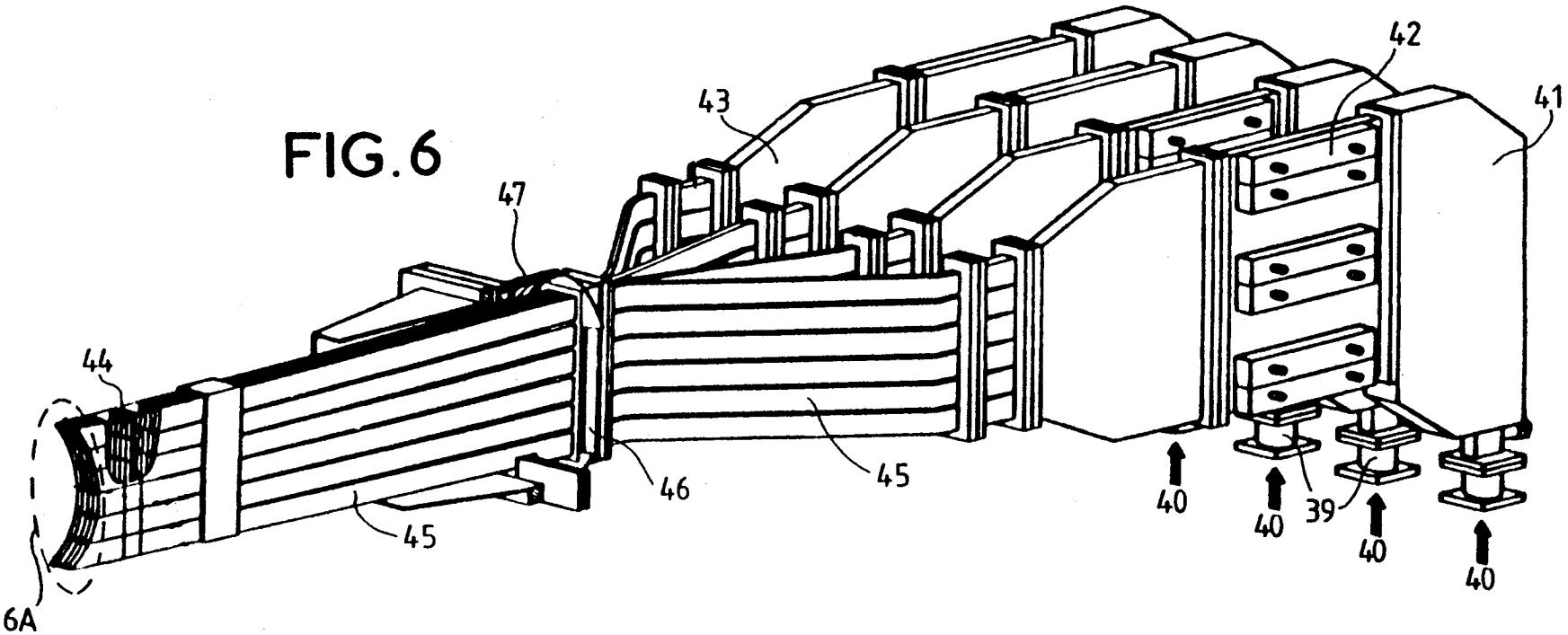
FIG. 6 is a schematic perspective view of a power distribution "grill", of a type known to industry, used to heat plasma for thermonuclear fusion by microwave power.
Figure 6A:
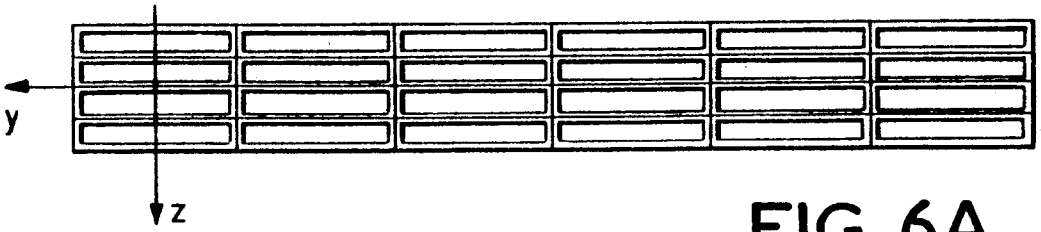
FIG. 6A is a detail of a portion of the device shown in FIG. 6.

FIG. 6 shows an example of a power distributor, complying with the prior art, applied to plasma heating for thermonuclear fusion in a Tokomak. The microwave power generated by the microwave source(s) is applied at inputs 40 via conventional dielectric windows 39. Splitter 41 then distributes it between several guides. Couplers 42 are used to measure the power in the various guides before phase correction in 43. The multiple secondary guides are then connected by a flange 46, with bellows 47, to the grid shown in detail in FIG. 6A. The guides are closed by a thick ceramic window 44 just upstream of grid 6A, whose exact shape depends on the geometry of the load in a given application. Windows 39 and 44 hermetically seal the distributor which can then either be placed under vacuum or filled with a pressurized gas.

The splitter in FIG. 6 was designed to operate with 4 separate 200 kW microwave sources (in fact, klystrons) feeding microwave inlets 40. The four klystrons can be replaced by a conventional 800 kW gyrotron (with a single microwave outlet) and a four-outlet power splitter. With a more powerful gyrotron containing a mode converter/power splitter complying with the invention, microwave power can be fed to several splitters as shown in FIG. 6 without any intermediate power splitting stage.

The mode converter and power splitter complying with the invention offers advantages when built into the outlet cavity from a gyrotron or any other high-power microwave source. It then offers a number of advantages, since the thermal stresses on the dielectric windows are reduced by a ratio proportional to the number of secondary guides; the cooling systems required are therefore mechanically simpler since these windows can be at some distance from the collector and the surrounding electromagnets. The transmission of the microwave power is also easier since it is in the fundamental mode which means it can be fed through guides which include elbows and, if necessary, adiabatic changes in section, without generating unwanted modes. Moreover, for applications such as plasma heating, where the energy must be spread in space before being applied to the load (i.e. the plasma), a system complying with the invention eliminates at least one splitter stage while ensuring that all secondary guides are excited absolutely in phase. All these technical advantages lead to considerable economies in the construction of a microwave system to heat plasma and allow optimum performance to be obtained.

What is claimed is:

1. An electromagnetic wave converter and microwave power splitter device for a microwave tube, the microwave tube comprising at least one outlet cavity having at least one end, to extract $TE_{m,n}$ mode, where m and n are integers, microwave energy generated by utilizing an electron beam generator coupled to the microwave tube, the outlet cavity having a cylindrical shape connfiguration disposed around a longitudinal centerline and the electron beam propagating in a direction at least approximately parallel to the centerline, said electromagnetic wave converter and microwave power splitter device comprising:

a plurality of secondary waveguides being arranged symmetrically around the longitudinal centerline, the plurality of secondary waveguides being disposed within the at least one outlet cavity;

each of the plurality of secondary waveguides comprising coupling apertures over a predetermined section of a length of each of the plurality of secondary waveguides which are parallel with the longitudinal centerline, each predetermined section disposed within the at least one outlet cavity and the coupling apertures being arranged to allow excitation of a desired propagation mode within the plurality of secondary waveguides.

2. The mode converter and power splitter device according to claim 1, wherein the secondary waveguides each further comprise at least one microwave window at the at least one end of the at least one outlet cavity.

3. The mode converter and power splitter device according to either one of claims 1 or 2, wherein the plurality of said secondary waveguides are 1 in number and where $l=2\ m/i$, where m is an azimuth index of the mode $TE_{m,n}$ and i is a whole number other than zero.

4. The mode converter and power splitter device according to claim 3, wherein the whole number $i=1$.

5. The mode converter and power splitter device according to claim 3, wherein the whole number $i=2$.

* * * * *